United States Patent [19]

Llewellin et al.

[11] Patent Number: 4,950,174

[45] Date of Patent: Aug. 21, 1990

[54] FIELD SEPARABLE ORDNANCE STEPOVER BRACKET

[75] Inventors: William R. Llewellin; Verne W. Carlson, both of Littleton, Colo.

[73] Assignee: The United States of America as represented by the Secretary of the Air Force, Washington, D.C.

[21] Appl. No.: 313,115

[22] Filed: Feb. 21, 1989

[51] Int. Cl.[5] ..... H01R 13/62

[52] U.S. Cl. ..... 439/158; 439/258

[58] Field of Search ..... 439/152–160, 439/258, 180, 540–572; 89/1.811, 1.814; 244/134, 137.4, 128, 118.2, 122 AD

[56] References Cited

U.S. PATENT DOCUMENTS

| | | | |
|---|---|---|---|
| 2,779,283 | 1/1957 | Baughman | 102/49 |
| 2,959,129 | 11/1960 | Warren | 102/92.5 |
| 3,112,672 | 12/1963 | Webb | 89/1.811 |
| 3,116,895 | 1/1964 | Mitchum, Jr. | 244/1 |
| 3,174,706 | 3/1965 | Wagner | 244/1 |
| 3,187,292 | 6/1965 | Small et al. | 439/564 |
| 3,249,012 | 5/1966 | Clinckner, Jr. | 89/1.811 |
| 3,328,743 | 6/1967 | Accord | 339/45 |
| 3,374,457 | 3/1968 | Herrick | 339/45 |
| 3,883,209 | 5/1975 | Kongelbeck | 439/572 |
| 4,264,115 | 4/1981 | Chow | 339/45 M |
| 4,580,862 | 4/1986 | Johnson | 439/248 |
| 4,711,177 | 12/1987 | Foster, Jr. et al. | 102/204 |
| 4,842,537 | 6/1989 | Villiers | 439/246 |

*Primary Examiner*—David Pirlot

*Attorney, Agent, or Firm*—William G. Auton; Donald J. Singer

[57] ABSTRACT

A field separable ordnance stepover bracket connects abutting ordnance transfer fuse cables across the interstage junction of a multistage missile system using a plug and a receptacle. The plug receives a first set of ordnance transfer cables that terminate in percussion devices; and fits with the receptacle which receives a second set of similar ordnance transfer fuse cables. For maintenance, the plug is simply unplugged from the receptacle to allow access to the interior of the missile when the interstage junction is opened. For flight interstage separation, the fast burning ordnance transfer fuse cables ignite the percussion charges which are fixed in proximity to a linear shaped charge that circumscribes a flight separation junction. The percussion charges ignite the linear shaped charge which detonates to separate the stages of the missile.

1 Claim, 3 Drawing Sheets

FLIGHT JOINT CONFIGURATION

FIELD JOINT
CONFIGURATION

FIELD SEPARABLE ORDNANCE STEPOVER BRACKET

BACKGROUND OF THE INVENTION

The present invention relates generally to stage separation ordnance systems used in multistage missile systems, and more specifically to a separable interstage ordnance bracket that permits the use of a field joint across an ordnance cable.

Multistage missile systems use stage separation charges to rapidly disengage adjacent missile stage structures during flight. A common configuration includes the use of a linear shaped charge which forms an annular stage separation percussion ring which circumscribes a flight separation joint between two adjacent missile stages. In operation this stage separation percussion ring detonates at the flight separation joint to separate the two missile stage structures, when the linear charge is ignited by a fast burning ordnance transfer fuse cable.

Multistage missile systems resemble the family automobile, in that they require routine maintenance and inspections to be performed periodically. For this reason, multistage missile systems have two types of joints that separate adjacent missile stages. The first is the flight separation joint, which separates during flight upon the detonation of the stage separation percussion ring. The second type of interstage joint is the field separation joint, which mechanically disengages while the missile is on the ground to provide access for field servicing.

The problem with field servicing and the use of the field separation joint is that the ordnance transfer cables (that cross between the two adjacent missile stages) also need to be separated when the joint is broken. Current practice uses two rigid halves bracketing a separation charge retainer, with a dowel pin serving as an alignment aid. This serves as a separable joint only at stage separation. Field servicing requires an extra service loop of ordnance line to permit detaching the line from the stepover bracket after separating the stages far enough to permit access to the bracket area.

The task of facilitating field stage separation when ordnance transfer cables traverse a field joint is alleviated, to some extent, by the systems disclosed in the following U.S. patents, the disclosures of which are incorporated herein by reference:

U.S. Pat. No. 2,770,283 issued to Baughman;
U.S. Pat. No. 2,959,129 issued to Warren;
U.S. Pat. No. 3,116,895 issued to Mitchum, Jr.;
U.S. Pat. No. 3,174,706 issued to Wagner;
U.S. Pat. No. 3,328,743 issued to Acord;
U.S. Pat. No. 3,374,457 issued to Herrick;
U.S. Pat. No. 4,264,115 issued to Chow; and
U.S. Pat. No. 4,711,177 issued to Foster et al.

The Baughman reference discloses a means to attach a booster rocket to an aerial missle. The attaching means is in the form of a mechanical connection with an automatic release. Release is attained by impinging high pressure gas on a pawl of the mechanical connection.

The Warren reference discloses an apparatus to connect stages of a missile and allow for quick release. The apparatus includes a flange on adjacent stages which are juxtaposed and held together by a band. The band, in turn, is held together by a quick release connector(s) operative upon release of pressure controlled by a timing device.

The Mitchum reference relates to apparatus to connect (or couple) a satellite to a rocket. Release of the structures follows an electrical pulse to actuate a motor that ultimately releases a spring in compression to exit a separating force. Wagner discloses a concept similar to Mitchum Jr. In this patent, separation of structure occurs upon activation of a plurality of cylinders which push a rod radially outward. Pressure to operate the cylinders is in the form of a fluid generated by a plurality of squibs. The squibs activate on a timed signal and the rods function to disengage individual clamp components to separate the satellite from the missile.

The Accord reference discloses a quick connect/disconnect electrical connector in the environment of a missile and an airplane. An electrical flow path through the connector provides for separation and disconnection of the same upon application of a force. Herrick discloses disconnect couplings for separably coupling adjacent stages of a multistage rocket or other type of space vehicle. Disconnection is attained without detrimental thrust or drag on the forward stage. The Foster patent discloses various ordnance detonation components in an auxiliary booster system.

Chow discloses a connector for connecting power and/or signal circuits between adjacent missile stages. The connector include individual housings mounted to respective missile stages at the line of flight separation between stages. A separation assembly is provided for disengaging the electrical contacts independently of the separation of the connector housings and the stages. The separation assembly includes a squib for generation of an expanding, pressurized gas.

While the above-cited references are instructive, the task remains to provide a connector which permits the components to be joined along a field separation joint, yet permit the components to separate and remain with the respective structures to which they are mounted when the stages separate along a different separation joint. The present invention is intended to satisfy that need.

SUMMARY OF THE INVENTION

The present invention is a field separable ordnance stepover bracket that connects pairs of ordnance transfer cables that cross the field separation joint of adjacent missile stages.

One embodiment of the invention includes a receptacle fixed to a structural component, for example, a missile stage structure, and a plug mounted to a second structural component, such as a shroud structure. The plug is designed for mating engagement in the receptacle across a field separation joint. An entry into the receptacle opens toward the plug across the separation joint. Ordnance cabling extends into each component of the device, and each component of the device is fitted with percussion type ordnance. The device permits use of a joint across an ordnance cable which, when the joint is broken, does not require a separate operation to break the ordnance cabling. The plug is supported at one end of a spring mount, the other end of which is attached at a location remote from the field separation joint. The mounting of the plug allows the components to separate and remain with the structure to which they are connected when the missile stage structure and shroud separate at a flight separation joint.

DESCRIPTIONS OF THE DRAWINGS

DETAILED DESCRIPTION OF THE PREFERRED EMBODIMENT

The present invention is a field separable ordnance stepover bracket that permits ordnance transfer cables to be connected across a field separation joint.

Figure 1:
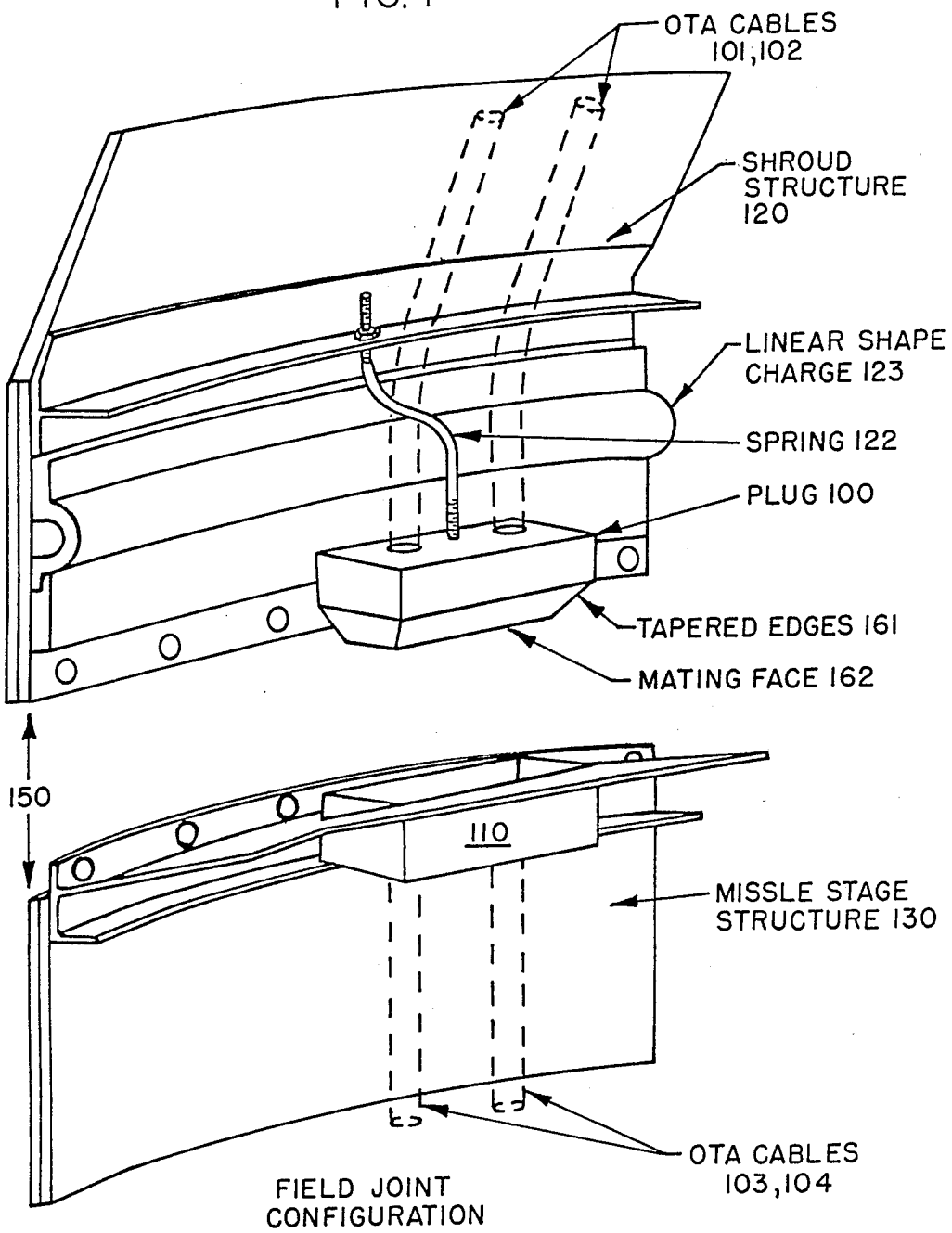
FIGS. 1–3 are different views of the present invention.

The reader's attention is now directed towards FIG. 1, which is an illustration of the present invention as it spans two adjacent missile stage structures 120 and 130 which are separated at the field separation joint 150. The system of FIG. 1 connects a first set of ordnance transfer fuse cables 101, 102 with a second set of ordnance transfer fuse cables 103, 104 across the field separation joint 150 using an aluminum plug 100 and receptacle 110, tapered on the mating sides such that the mating faces are aligned very closely, typically to 0.020 inches. Both the plug and the receptacle are fitted with percussion type ordnance termination devices. In this example, the receptacle 110 is fixed in a lower structure 130 and the plug 100 is mounted on the end of a short length of spring wire 122. In this case 0.190 DIA, having sufficient bends or turns to allow three degrees of freedom movement of the plug relative to the fixed end of the spring 122.

The spring 122 can be mounted in a variety of ways at the fixed end and is threaded on the plug end, allowing the free height of the plug 100 to be preset. The use of self-locking thread inserts in the plug and the presence of the ordnance transfer cable prevents excessive rotation of the plug and the presence of the ordnance transfer cable prevents excessive rotation of the plug after assembly. When the two structural pieces (in this case a missile and its shroud) are fitted together, the plug can self-align to the receptacle and mate up, with a fairly predictable preload against it. The taper is used for the alignment of the first set of cables 101 and 102 with the second set 103 and 104 when the plug 100 is fitted into the receptacle 110.

The ordnance transfer fuse cables 101–104 are pairs of abutting fast burning fuse cables that terminate in percussion charges that are housed in both the plug 100 and receptacle 110. The ordnance transfer fuse cables 101–104 as well as the percussion charges are commercially-available ordnance ignition items similar to the fuse and booster charge described in the above-cited Foster et al patent. For example, the percussion charges as well as the linear shaped charge can be composed of cyclotrimethylene trinitramine and similar substances which need not be redescribed here.

The system of FIG. 1 allows for easy separation of the ordnance transfer fuse cables, and this device is usable wherever ordnance must traverse a field joint. It may be applied in stage separation applications, or may be extended to such applications as emergency blowout doors or the like, when the ordnance line must cross a field joint, service panel, or other access door.

The advantage of the system of FIG. 1 is that the device permits the use of a field joint across an ordnance fuse cable which, when the field joint is broken, does not require a separate operation to break the ordnance cabling. The plug 100 and receptacle 110 permits the two sets of ordnance transfer cables to be physically disconnected for maintenance when the shroud structure 120 becomes physically separated from the missile stage structure 130. This physical separation may occur at either the field separation joint 150 of FIG. 1, or the flight separation joint 160 of FIG. 2. Regardless of the joint used, any physical separation of the shroud 120 from the missile stage 130 will automatically cause the plug 100 to separate from the receptacle 110, for the reasons discussed below. Normally, it is the field separation joint 150 of FIG. 1 that is used for stage separation for missile maintenance. The flight separation joint 160 of FIG. 2 is most commonly used with the linear shaped charge 123 is detonated to effect stage separation during the missile flight.

As mentioned above, FIG. 1 is an illustration of the separation of the shroud structure 120 from the missile stage structure 130 across the field separation joint 150. Such physical separation will cause the plug 100 to detach from the receptacle 110 for the following reasons. First, it is important to note that the receptacle structure 110 includes a bracket that is physically fixed to the missile stage structure 130. Second, plug 100 is fixed to the shroud structure 120 by the spring 122. Third, and most important, the plug 100 does not have an interference fit within the receptacle 110. The plug 100 with its sides, tapered edges 161 and mating face 162 all fit within the receptacle 110 with a clearance of about 0.020 inches. The receptacle 110 has a complementary interior which has dimensions that allow the plug 100 to be easily detached when the shroud 120 separates from the missile stage 130 at either the field separation joint 150, or the flight separation joint 160. Additionally, as mentioned above, both the plug and receptacle can house ordnance percussion termination devices which detonate upon receipt of ignition from the ordnance transfer fuse cables. These devices are conventional metal caps which house a charge that detonate upon ignition, and are believed to be known in the art including the squibs used in the above-cited Chow reference and the charges in the Foster Patent.

Figure 2:
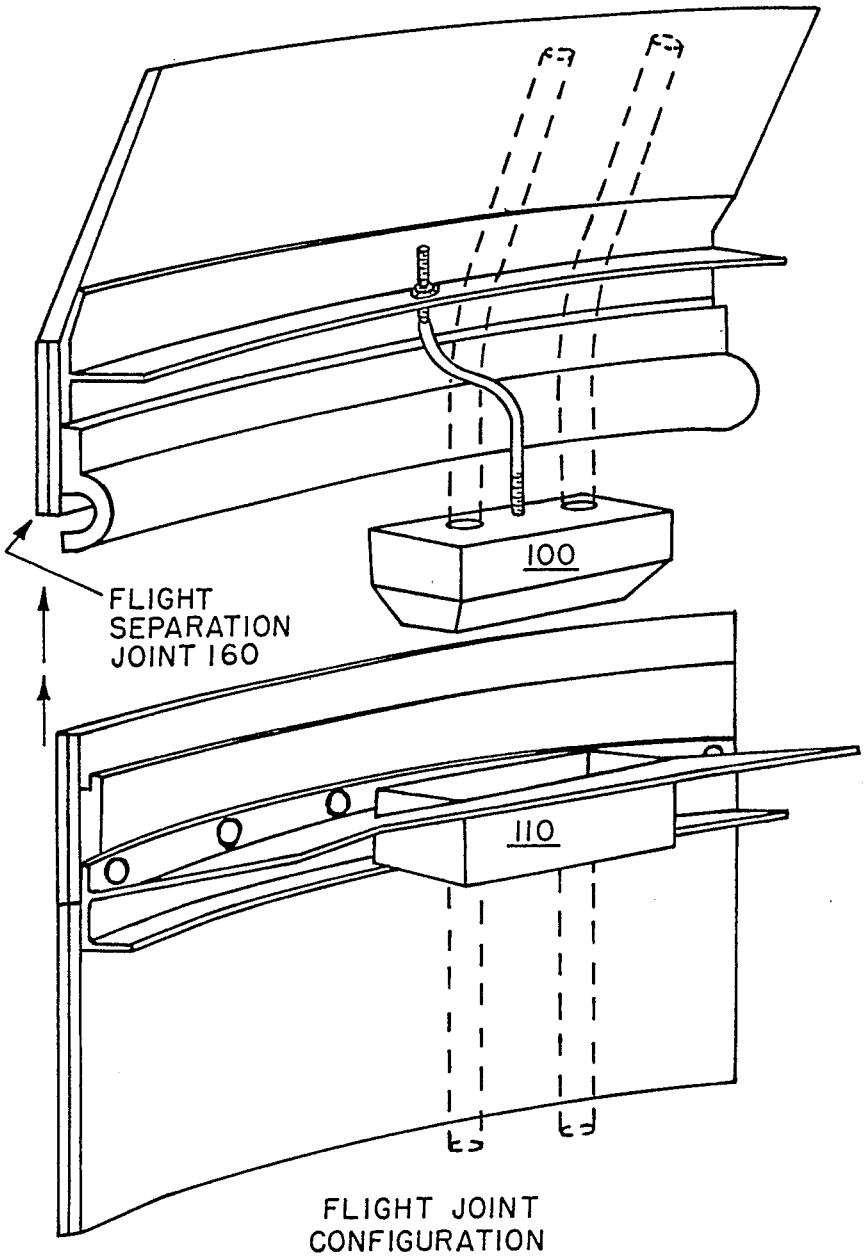

FIG. 2 is an illustration of the multi-stage missile system where the interstage separation is made at the flight separation joint 160. The purpose of FIG. 2 is simply to illustrate the difference between the flight separation joint 160 and the field separation joint 150.

The field separation joint 150 is most commonly used for maintenance. The present invention allows the ordnance transfer cables 101–104 to be separated when the shroud structure 120 is separated from the other missile stage structure 130 at the field separation joint. In reality, the flight separation joint is more commonly expected to occur during missile flight after the fast burning ordnance transfer fuse cables 101–104 have been ignited by a fuse (not shown) and have, in turn, ignited the percussion charges housed in the plug 100 and receptacle 110. This operation is best understood in the context of the description of FIG. 3, which follows.

Figure 3:
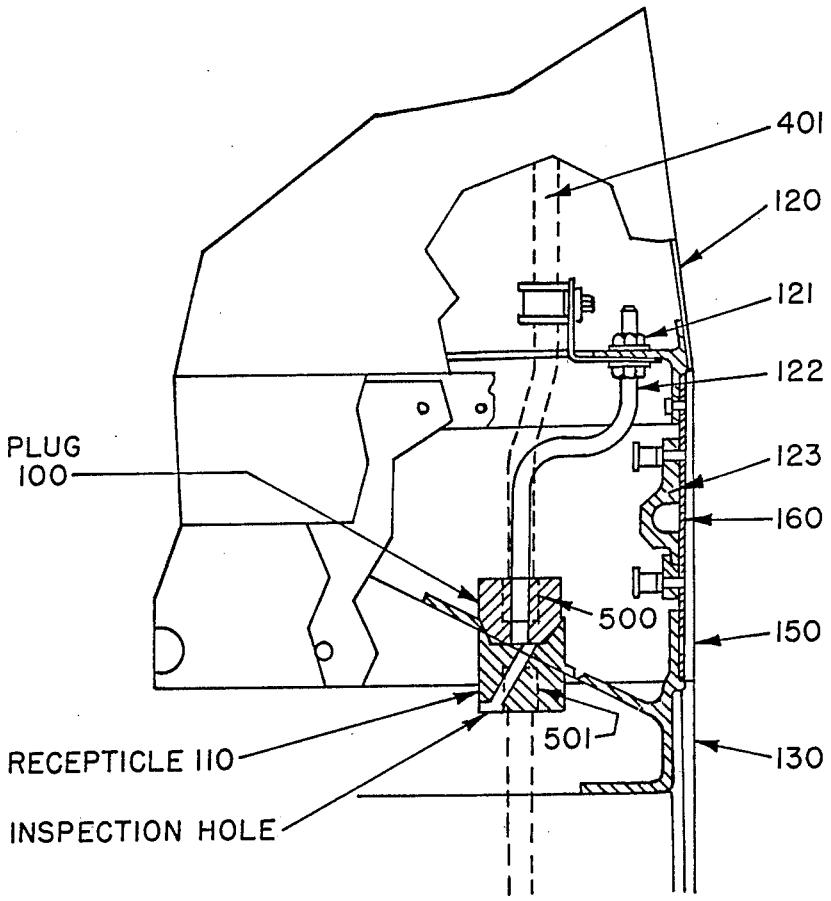

FIG. 3 is a detached side view of the system of FIGS. 1 and 2 with a break away view of the multi-stage missile. As shown, both the ordnance transfer cables 401 and 403 terminate in percussion type ignition charges 500 and 501 which are housed in the plug 100 and receptacle 110.

In operation, the fast burning ordnance transfer fuse cables are ignited by an electrical fuse circuit. The ordnance transfer fuse cables 401 and 403 ignite the percussion type ignition charges 500 and 501, which are in proximity with the linear shaped charge 123. As mentioned above, the percussion type charges are similar to the booster charge of the Foster et al patent: just as the booster charge ignites the main charge in the Foster munitions system; the ignition charges 500 and 501 ignite the linear shaped charge 123 that circumscribes the flight separation joint 160 between the two stages of the missile. The detonation of the linear shaped charge 123 results in a shock percussion that separates the shroud stage 120 from the adjacent missile stage 130. Additionally, a small angled hole is provided at the base of the receptacle 110 which allows mateup with the plug to be verified as follows. If the top side of the joint is neither accessible nor visible, mateup may be verified by inserting a probe wire through the small angled hole through the base of the receptacle.

In this age of modular electronic components and electrical plugs, it is about time that a quick connect-/disconnect ordnance transfer assembly usable whenever ordnance must traverse a field joint. The need for such a system is partly due to the fact that multi-stage missile systems resemble the family car, in that they require routine inspections and maintenance. For this reason, the system in FIG. 1 permits a quick disconnect of ordnance cabling when the field separation joint 150 is opened to permit such maintenance.

Figure 4:
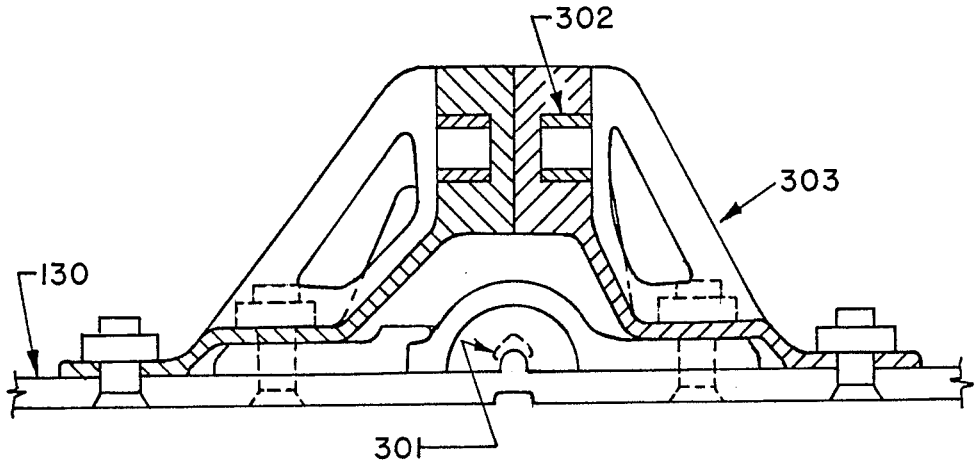
FIG. 4 PRIOR ART
FIG. 4 is a plan view of the prior art system replaced by the present invention.

FIG. 4 is a plan view of a prior art system which uses two rigid halves bracketing a separation charge retainer 301 with a dowel pin 302 serving as an alignment aid. This serves as a separable joint only at stage separation. Field servicing requires an extra service loop of ordnance line to permit detaching the line from the stepover bracket after separating the stages far enough to permit access to the bracket area.

The present invention is believed to be an advance over the system of FIG. 4. The current practice is to terminate the ordnance transfer fuse cable directly into the initiator of the linear shaped stage separation charge 301 of FIG. 4 in a permanent connection. As mentioned above, maintenance requires that the cable be: detached from the stage separation charge; and that an extra length of cable be provided to allow either of the interstage separation joints to be opened. This cumbersome practice is avoided by the plug and receptacle fixtures of the present invention. The system of FIGS. 1–3 allows easy separation of the cables for maintenance.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. In a multistage missile system which has a plurality or ordnance transfer cables that traverse missile stages including a first set of ordnance transfer fuse cables in a first missile stage and a second set of ordnance transfer fuse cables in a second missile stage, an ordnance stepover bracket which connects said first and second set of ordnance transfer fuse cables across an interstage junction between said first and second missile stages, wherein said interstage junction in said missile includes a field separation joint which allows said first and second missile stages to be physically disconnected and separated for maintenance and inspections, and a flight separation joint which is lined with a linear shaped charge which detonates during flight to physically separate said first and second stages, wherein said ordnance stepover bracket comprises:

a plug which is connected with and receives said first set of ordnance transfer fuse cables in its top, and which has a bottom exterior which has tapered edges and a first mating face, said first mating face of said plug being connected with said first set of ordnance transfer fuse cables;

a receptacle which is connected with and receives said second set of ordnance transfer fuse cables in its bottom, said receptacle having a top indentation which has a complementary interior having interior dimensions into which said plug may be inserted such that said first and second mating faces come into contact, said interior dimensions of said complementary interior having a clearance which allows said plug to be easily removed upon any physical separation between said first and second missile stages across said interstage junction;

a plurality of percussion charges which are housed in said plug and said receptacle at the ends of said first and second sets of ordnance transfer fuse cables, said plurality of percussion charges being ignited by said ordnance transfer fuse cables during flight separation to produce a percussion wave that ignites said linear shaped charge;

a bracket which is fixed to saidreceptacle receptacle and which attaches it to said second missile stage in close proximity with said linear shaped charge so that said percussion charges will ignite said linear shaped charge upon their detonation during a flight stage separation event; and a spring which is fixed to said first missile stage at one end, and which is fixed to said plug at its other end, said spring having a length which allows said plug to reach into said receptacle for mateup of said plug and said receptacle.

* * * * *